US005890048A

United States Patent [19]

Hirota

[11] Patent Number: 5,890,048

[45] Date of Patent: Mar. 30, 1999

[54] CLEANING DEVICE

[75] Inventor: Shingo Hirota, Kobe, Japan

[73] Assignee: Minolta Co., Ltd., Osaka, Japan

[21] Appl. No.: 44,116

[22] Filed: Mar. 19, 1998

[30] Foreign Application Priority Data

Mar. 21, 1997 [JP] Japan ..... 9-068778

[51] Int. Cl.[6] ..... G03G 21/10

[52] U.S. Cl. ..... 399/358; 399/360

[58] Field of Search ..... 399/357, 358, 399/350, 351, 360, 352, 359; 355/298; 15/256.5, 256.51, 256.2; 430/125

[56] References Cited

U.S. PATENT DOCUMENTS 3,881,446 5/1975 Kurita et al. .
4,601,569 7/1986 Garris ..... 399/358
4,819,031 4/1989 Thayer et al. ..... 399/358
5,341,199 8/1994 Thorp et al. ..... 399/350

FOREIGN PATENT DOCUMENTS 2-81078 3/1990 Japan .

*Primary Examiner*—Arthur T. Grimley
*Assistant Examiner*—William A. Noe
*Attorney, Agent, or Firm*—Burns, Doane, Swecker & Mathis, LLP

[57] ABSTRACT

A cleaning device for cleaning residual toner on a toner image carrier. The cleaning device includes a blade that comes into contact with the toner image carrier at an acute angle with respect to an immediate downstream portion of the toner image carrier at a toner removal area where the blade scrapes off residual toner from the toner image carrier. A collecting device moves in a direction opposite the direction of movement of the toner image carrier at the toner removal area and collects the residual toner scraped off by the blade member.

14 Claims, 5 Drawing Sheets

CLEANING DEVICE

BACKGROUND OF THE INVENTION

1. Field of the Invention

The present invention pertains to a cleaning device, and more particularly to a cleaning device for cleaning the residual toner on the toner image carrier in, for example, an electrophotographic copying machine, facsimile or printer.

2. Description of the Related Art

Generally, in an electrophotographic copying machine, etc., a toner image that is formed on the toner image carrier that comprises a photoreceptor or dielectric member is transferred onto a sheet of paper. When this occurs, however, the toner on the image carrier is not completely transferred and approximately 10% to 20% of the toner remains on the toner image carrier. This residual toner needs to be cleaned off so that it will not cause smudging of the image during the next image formation process.

As a cleaning device to clean residual toner, the device shown in FIG. 6 is conventionally known. In this cleaning device, blade 65 is caused to come into contact with photoreceptor drum 60 from the direction opposite the direction of movement of said photoreceptor drum (arrow d), and the residual toner scraped off by said blade 65 is pushed out, so to speak, to carrier groove 62 by means of vane member 66 that rotates in the direction of arrow e so that the residual toner will be carried outside of casing 61 by means of the rotation of coil 63 mounted in carrier groove 62.

Incidentally, in the conventional cleaning device, the direction of movement of vane member 66 at toner removal area C is the same as the direction of movement of photoreceptor drum 60. Therefore, as shown in FIG. 7, vane member 66 presses down toner T that was scraped off by the edge of blade 65 and blade 65 itself onto the surface of photoreceptor drum 60. Therefore, this cleaning device not only reduces the efficiency in scraping off toner T but also causes caking of residual toner T. When the toner cakes, it causes various problems, including toner scattering outside casing 61, damage to blade 65 and photoreceptor drum 60, and smudging of the image during the next image formation process.

OBJECTS AND SUMMARY

One object of the present invention, therefore, is to provide a cleaning device that can prevent caking of the residual toner and is capable of highly efficient residual toner collection.

Another object of the present invention is to provide a cleaning device that can also be reduced in size.

In order to attain the objects described above, the cleaning device of the present invention comprises a blade member which scrapes off the residual toner on the toner image carrier and a collecting means which collects the residual toner scraped off by the blade member, wherein the blade member comes into contact with toner image carrier from the direction opposite the direction of movement of the toner image carrier, and the collecting means is mounted such that it will move in the direction opposite the direction of movement of the toner image carrier at the toner removal area.

In the present invention, the blade member scrapes off the residual toner on the toner image carrier using the edge of its tip. The collecting means collects the scraped-off toner from the direction opposite the direction of movement of the toner image carrier. The collection of the toner by the collecting means is carried out by scooping up or raking up the toner, so that no excess pressure is exerted by the vane member onto the edge of the blade and the force that presses the residual toner onto the toner image carrier is small. Consequently, the toner will not cake and collection efficiency also improves.

Furthermore, in the present invention, it is preferred that the carrying means that takes in and carries the toner collected by the collecting means to the housing member be mounted either near the supporting member that supports the blade member or inside the collecting means. Such a construction makes the cleaning device generally compact.

In the present invention, the collecting means comprises a rotary member equipped with multiple vane members that extend essentially outward from the outer circumference of said rotary member. For example, it may comprise a paddle wheel, belt, spiral rotary member or cross-flow fan having multiple vane members. It is preferred that the vane members' rotational vectors and the outward extensions be narrow angles in order to ensure more reliable scooping of the scraped-off toner and improved collection efficiency.

In the present invention, a wall that prevents spillage of the toner collected by the vane members is mounted at a location at which the wall will face the locus of rotation of the vane member tips. Using this wall, the collected toner is not allowed to escape from the vane members and reliable collection is achieved.

DETAILED EXPLANATION OF THE PREFERRED EMBODIMENTS

Embodiments of the cleaning device of the present invention are explained below with reference to the attached drawings. Same numbers are used for members and components that are common among the embodiments explained below.

Figure 1:
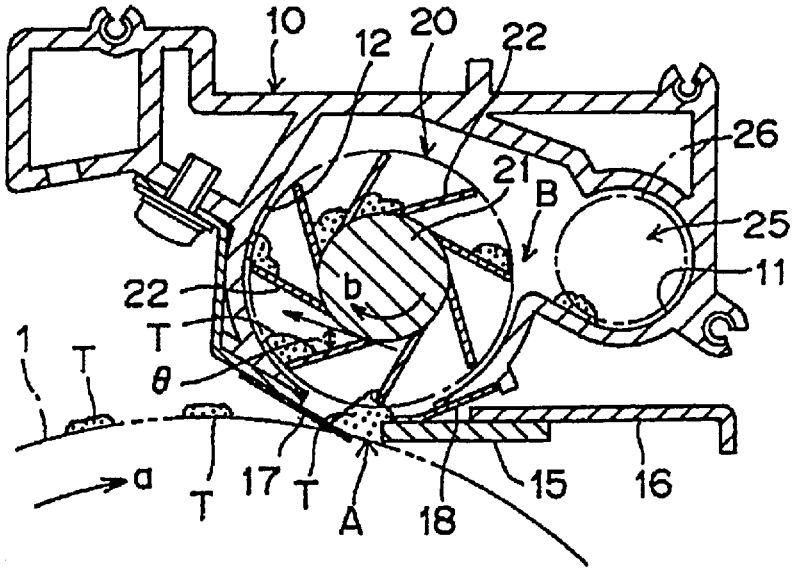
FIG. 1 is a cross-sectional view showing the cleaning device of the first embodiment of the present invention.

The cleaning device of the first embodiment is provided in an electrophotographic copying apparatus. The cleaning device is mounted above the photoreceptor drum 1 which is driven to rotate in the direction of arrow a. Charging device, image exposing device, developing device, transfer charging device, and so on, all of which are well known, are mounted around photoreceptor drum 1, although they are not shown in FIG. 1.

The cleaning device comprises casing 10, blade 15, paddle wheel 20 and toner carrier 25. Blade 15 is supported by supporting plate 16 at its base end. Its tip edge is in contact under a certain pressure with photoreceptor drum 1 from the direction opposite the direction of movement of said photoreceptor drum 1. Paddle wheel 20 comprises rotary shaft 21 to which multiple vane members 22 are attached at equal intervals such that they will extend outward at certain angles $\theta_1$, and is driven to rotate in the direction of arrow b. Vane members 22 are made of a metal or resin material, or a combination thereof. The rotation speed of paddle wheel 20 is set within a range of 10 rpm to 100 rpm.

Toner carrier 25 for carrying collected toner is mounted directly above supporting plate 16. Spiral coil 26 is rotatably mounted in carrying groove 11 whose cross-section is essentially round and comprises part of casing 10. Wall 12 having an arc-shaped cross-section is formed on casing 10 at the location where said wall will face the locus of rotation of the tips of vane members 22. This wall extends in the direction of arrow b from residual toner removal area A to the area slightly above paddle wheel 20. Further, sealing members 17 and 18 for preventing scattering of toner are also attached to the opening that faces removal area A of casing 10.

In the construction described above, residual toner T on photoreceptor drum 1 that rotates in the direction of arrow a is scraped off by the edge of blade 15 at area A. In this stage, paddle wheel 20 is driven to rotate in the direction of arrow b so that each vane member 22 will scoop up the scraped off toner T at removal area A and carry said toner T upward on its front surface in terms of the direction of rotation. When it passes the upper area of paddle wheel 20, toner T moves to the rear surface of vane member 22 immediately in the front. At transfer area B, toner T slides down said rear surface into groove 11. In groove 11, the toner is carried along the shaft by means of the rotation of coil 26 and is then housed in a collection bottle or tank mounted outside casing 10.

In the collection operation for the residual toner described above, vane members 22 scoop up toner T from the direction opposite the direction of movement of photoreceptor drum 1 at toner removal area A. Consequently, no excess pressure is exerted on the edge of blade 15 and the force that presses down toner T onto the surface of photoreceptor drum 1 is small, virtually eliminating the possibility of caking of toner T. Moreover, toner T located in the locus of movement of vane members 22 can be reliably collected, providing good collection efficiency.

In particular, because mounting angles $\theta_1$ of vane members 22, i.e., angles $\theta_1$ between the rotational vectors and the outward extensions of vane members 22, are set to be narrow angles, the toner can be efficiently scooped up, and excess pressure is prevented from being applied to the residual toner that was not scraped off.

The toner that is placed on the front surfaces of vane members 22 is guided by wall 12 and carried up to the upper area of paddle wheel 20. Consequently, toner is prevented from spilling while it is being carried and reliable collection is achieved. In addition, by mounting collected toner carrier 25 above but close to blade supporting plate 16, the entire cleaning device can be made compact.

Figure 2:
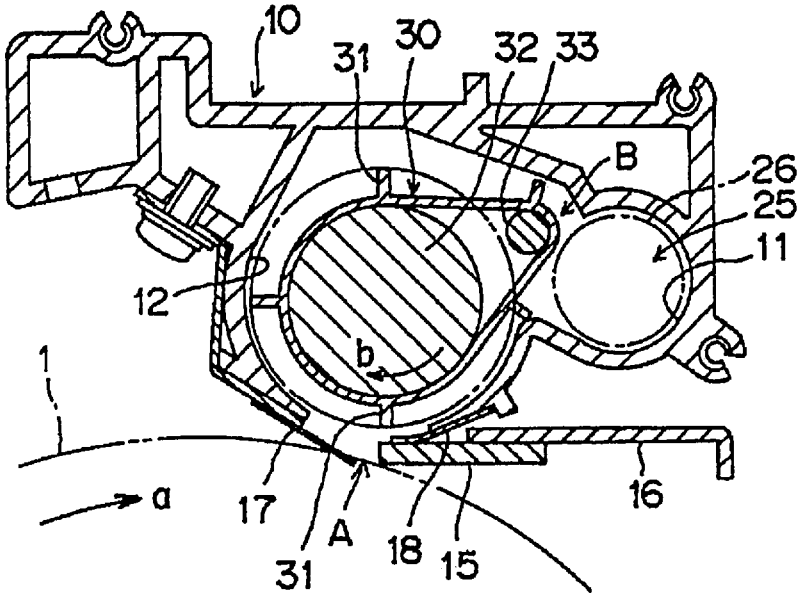
FIG. 2 is a cross-sectional view showing the cleaning device of the second embodiment of the present invention.

As illustrated in FIG. 2, the cleaning device of the second embodiment has collecting belt 30 in place of paddle wheel 20 used in the first embodiment. The collecting belt 30 is made of a flexible resin material. The collecting belt 30 has multiple protruding partition plates 31 on its outer circumference and is suspended over driving shaft 32 and auxiliary shaft 33 in a continuous fashion. Collecting belt 30 rotates in the direction of arrow b that is opposite the direction of movement of photoreceptor drum 1 at removal area A. The rotation speed of driving shaft 32 is set within a range of 10 rpm to 100 rpm.

Partition plates 31 rake up and collect the residual toner scraped off by blade 15 by means of the rotation of collecting belt 30 in the direction of arrow b, and send the residual toner to toner carrier 25 at transfer area B past auxiliary shaft 33.

No excess pressure is applied onto the residual toner or the edge of blade 15 by partition plates 31 in the second embodiment as well. Because a flexible collecting belt 30 is used, this embodiment is particularly effective when carrier 25 is mounted away from removal area A or when the toner is sent into toner carrier 25 via a complex route.

Figure 3:
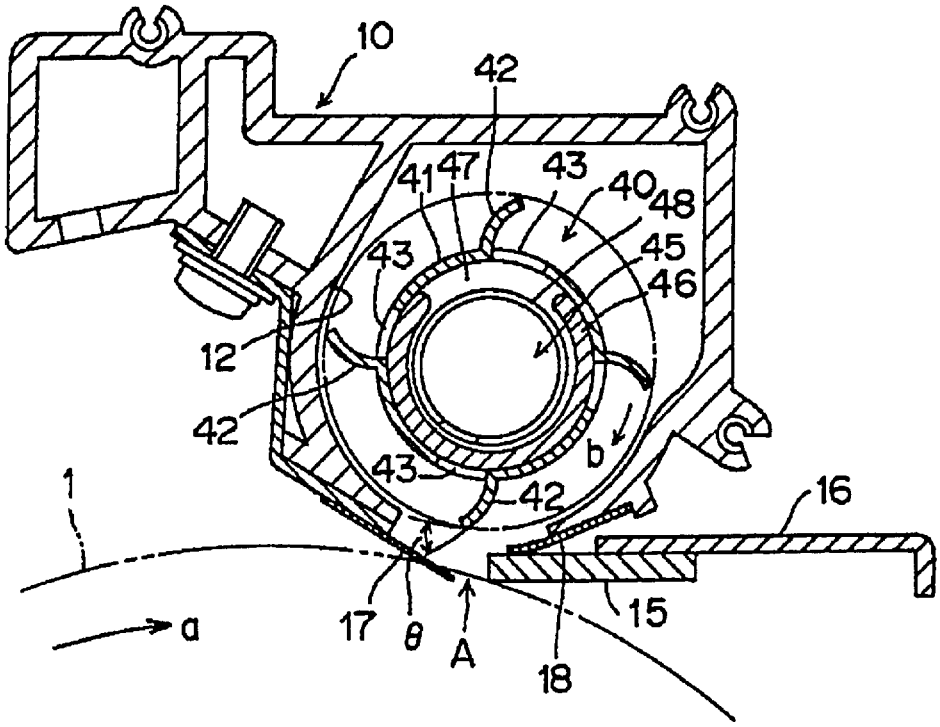
FIG. 3 is a cross-sectional view showing the cleaning device of the third embodiment of the present invention.
Figure 4:
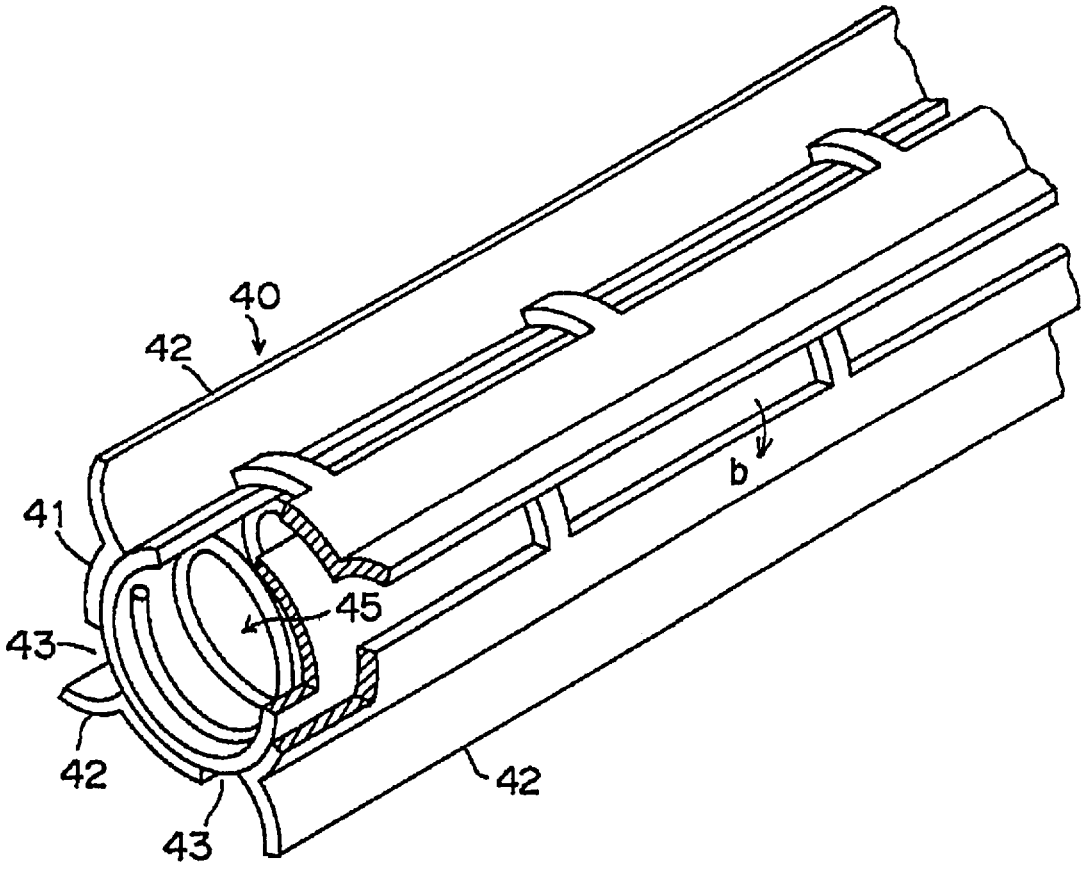
FIG. 4 is a perspective view of important parts of the cleaning device shown in FIG. 3.

As shown in FIGS. 3 and 4, the cleaning device of the third embodiment has paddle wheel 40 immediately above removal area A as well as collected toner carrier 45 that is integrally mounted inside paddle wheel 40.

Paddle wheel 40 comprises cylindrical member 41, multiple vane members 42 that are formed at equal intervals on the outer circumference of said cylindrical member such that they extend outward in a slightly curved fashion, and openings 43 that are formed at the roots of vane members 42. Paddle wheel 40 is driven to rotate in the direction of arrow b. Paddle wheel 40 is made of a metal or resin material or a combination thereof. Rotation speed of paddle wheel 40 is set within a range of 10 rpm to 100 rpm. Vane members 42 are mounted such that the angles $\theta_2$ between the rotational vectors and the outward extensions of vane members 42 at their tips are narrow angles.

Toner carrier 45 comprises carrier cylindrical member 46 which is inserted in cylindrical member 41 of paddle wheel 40 and spiral coil 48 that is rotatably mounted inside this cylindrical member 46. Cylindrical member 46 has opening 47 at the top and is fixed so that it will not rotate.

In the construction described above, the vane members 42 of paddle wheel 40 that rotate in the direction of arrow b scoop up the residual toner scraped off by blade 15 at removal area A for collection. The toner carried to the upper area of paddle wheel 40 falls into carrier cylindrical member 46 via openings 43 and 47, and is carried along the shaft by means of the rotation of coil 48. The toner is then housed in a collection bottle or tank mounted outside casing 10.

Vane members 42 in the third embodiment act in the same manner as vane members 22 in the first embodiment described above and have the same effect. In the third embodiment in particular, because toner carrier 45 is integrally mounted inside paddle wheel 40, the cleaning device may be made small in size and is therefore effective for use where there is a limited amount of space around photoreceptor drum 1.

Figure 5:
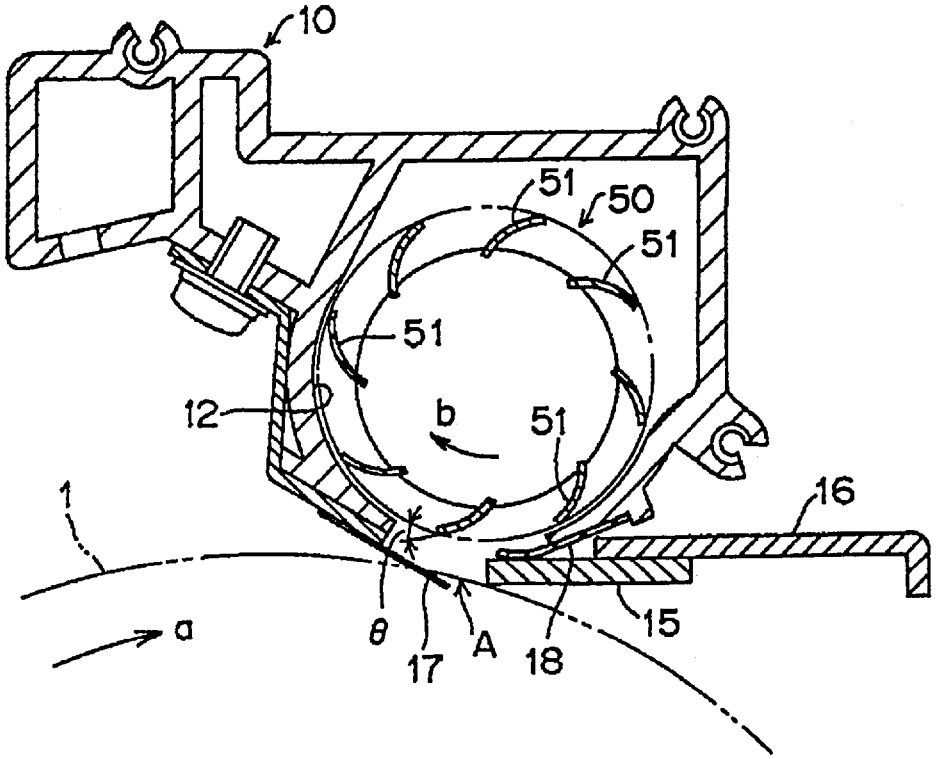
FIG. 5 is a cross-sectional view showing the cleaning device of the fourth embodiment of the present invention.
Figure 6:
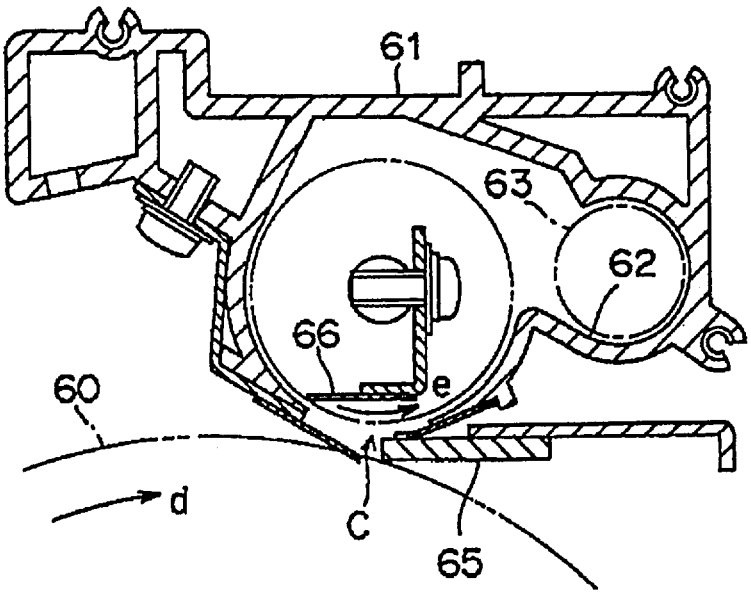
FIG. 6 is a cross-sectional view showing the conventional cleaning device.
Figure 7:
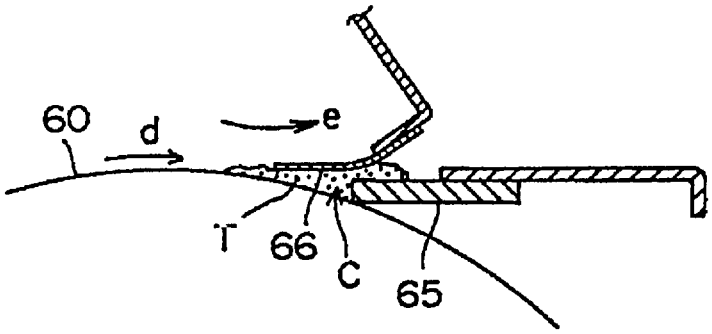
FIG. 7 is a drawing to explain the manner in which residual toner is collected in the conventional cleaning device.

As illustrated in FIG. 5, the cleaning device of the fourth embodiment has cross-flow fan 50 immediately above removal area A. Cross-flow fan 50 comprises vane members 51 mounted at equal intervals on the outer circumference of a rotary shaft in a slightly curved fashion. Vane members 51 scoop up the residual toner scraped off by blade 15 at removal area A for collection when the rotary shaft rotates in the direction of arrow b. The rotation speed of cross-flow fan 50 is set within the range of 500 rpm to 10000 rpm. Cross-flow fan 50 sucks in the scooped up toner, the toner scraped off by blade 15 and even floating toner in area A by means of the air flow from outside to inside of vane members 51 that is generated by the rotation, and carries the toner along its axial direction. A collection bag not shown in the drawing is mounted at the opening at the end of cross-flow fan 50 so that the toner carried by said air flow can be housed in it.

Vane members 51 are made of a metal or resin material, or a combination thereof. Angles $\theta_2$ between the rotational vectors and the outward extensions of vane members 51 at their tips are set to be narrow angles.

Vane members 51 in the fourth embodiment have the same action as that of vane members 22 and 42 in the first and third embodiments, respectively, and have the same effect. In addition, because the collecting mechanism and the toner carrier are integrally constructed, the cleaning device can be made small in size, as in the case of the third embodiment, which makes this embodiment effective for use where there is a limited amount of space around photoreceptor drum 1.

The cleaning device of the present invention is not limited to the embodiments described above, and may be implemented in various forms all within the scope of the present invention.

In particular, the location at which the cleaning device should be placed relative to the toner image carrier which comprises a photoreceptor or dielectric member need not be only above or near photoreceptor drum 1, although these are the locations shown in the embodiments.

What is claimed is:

1. A cleaning device comprising:

a blade member which comes into contact with a toner image carrier at an acute angle with respect to an immediate downstream portion of the toner image carrier at a toner removal area where said blade member scrapes off residual toner from the toner image carrier;

a collecting device having an interior and being rotatable in a direction the same as a direction of rotation of the toner image carrier at the toner removal area to collect the residual toner scraped off by said blade member;

a cylindrical member having an interior and being located in said interior of said collecting device, said collecting device being rotatable relative to said cylindrical member;

a toner carrying device located in said interior of said cylindrical member and being rotatable relative to said cylindrical member; and an opening in a surface of said collecting device and an opening in a surface of said cylindrical member, said openings communicating an exterior of said collecting device with said interior of said cylindrical member, said toner carrying device for carrying the toner collected by said collecting device to a toner collection area.

2. A cleaning device claimed in claim 1, further comprising a casing in which said collecting device is located, the toner collection area located outside said casing.

3. A cleaning device claimed in claim 1, wherein said collecting device comprises a rotary unit having multiple vane members that extend outwardly from said rotary unit.

4. A cleaning device claimed in claim 3, wherein each angle formed by a line tangent to a vane member at its tip, and a line tangent to said rotary unit at the base of said vane member is acute.

5. A cleaning device claimed in claim 3, wherein a wall for preventing spillage of the residual toner collected by said vane members is mounted at a location at which said wall faces a locus of rotation of tips of said vane members.

6. A cleaning device comprising:

a blade in contact with a surface of a toner image carrier that rotates in a first direction;

a rotatable collecting device having a second direction of rotation the same as said first direction of rotation and having a curved vane member, said curved vane member located so as to collect residual toner that has been removed from said surface of said toner image carrier by said blade.

7. A cleaning device as claimed in claim 6, wherein said curved vane member forms an acute angle with respect to a line tangent to a cylindrical surface of said rotatable collecting device, said curved vane member extending from the cylindrical surface at an acute angle with respect to a downstream portion of the cylindrical surface.

8. A cleaning device as claimed in claim 7, wherein said curved vane member is located so as to collect the residual toner by scooping the residual toner.

9. A cleaning device as claimed in claim 7, wherein said rotatable collecting device is positioned and sized to collect the residual toner by rotating at an angular velocity at which the residual toner is drawn towards said curved vane member by suction.

10. A cleaning device as claimed in claim 6, further comprising an opening in a cylindrical surface communicating an exterior of said rotatable collecting device within an interior of said rotatable collecting device such that said residual toner may be moved to said interior by rotation of said rotatable collecting device.

11. A cleaning device as claimed in claim 6, further comprising a toner carrier located adjacent to said rotatable collecting device.

12. A cleaning device comprising:

a blade in contact with a surface of a toner image carrier that rotates in a first direction; and a rotatable collecting device having a second direction of rotation the same as said first direction of rotation and having a vane member, said vane member located so as to collect residual toner that has been removed from said surface of said toner image carrier by said blade, said rotatable collecting device including a belt on which said vane member is positioned.

13. A cleaning device comprising:

a blade in contact with a surface of a toner image carrier that rotates in a first direction; and a rotatable collecting device having a second direction of rotation the same as said first direction of rotation and having a vane member, said vane member located so as to collect residual toner that has been removed from said surface of said toner image carrier by said blade, said rotatable collecting device being positioned and sized to collect the residual toner by rotating at an angular velocity at which the residual toner is drawn toward said vane member by suction.

14. A cleaning device comprising:

a blade member which comes into contact with a toner image carrier at an acute angle with respect to an immediate downstream portion of the toner image carrier at a toner removal area where said blade member scrapes off residual toner from the toner image carrier; and a collecting device having a curved vane that moves in a direction opposite a direction of movement of the toner image carrier at the toner removal area and collects the residual toner scraped off by said blade member.

* * * * *